US005881336A

United States Patent [19]

Sato

[11] Patent Number: 5,881,336

[45] **Date of Patent: *Mar. 9, 1999**

[54] IMAGE PRODUCING APPARATUS

[75] Inventor: Mitsuo Sato, Shibata, Japan

[73] Assignee: Tohoku Ricoh Co., Ltd., Miyagi, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 713,203

[22] Filed: Sep. 12, 1996

[30] Foreign Application Priority Data

Oct. 16, 1995 [JP] Japan ..... 7-266650
Jul. 9, 1996 [JP] Japan ..... 8-179540

[51] Int. Cl.[6] ..... G03G 21/02
[52] U.S. Cl. ..... 399/79; 399/85
[58] Field of Search ..... 399/79, 81, 82, 399/83, 403, 85

[56] References Cited

U.S. PATENT DOCUMENTS 4,393,375 7/1983 Sughiura et al. ..... 399/81
4,453,821 6/1984 Smith ..... 399/81
4,831,553 5/1989 Yoshino .
5,200,778 4/1993 Ito ..... 399/82
5,500,717 3/1996 Altrieth III ..... 399/83

FOREIGN PATENT DOCUMENTS 60-244967 12/1985 Japan .
62-096963 5/1987 Japan .
63 49937 4/1988 Japan .
5-68667 9/1993 Japan .

*Primary Examiner*—Robert Beatty
*Attorney, Agent, or Firm*—Oblon, Spivak, McClelland, Maier & Neustadt, P.C.

[57] ABSTRACT

An image producing apparatus including a control panel. When a school mode is selected, numeric or alphanumeric keys are pressed on a keypad so as to select one or a plurality of classes or grades. Numerical data concerning the number of students per class and grade are extracted, and are registered as the number of prints to be produced and sorted.

13 Claims, 8 Drawing Sheets

| | CLASS 1 | CLASS 2 | CLASS 3 | CLASS 4 | SUB-TOTAL |
|---|---|---|---|---|---|
| GRADE 1 | 30 | 28 | 32 | 31 | 121 |
| GRADE 2 | 34 | 33 | 32 | 30 | 129 |
| GRADE 3 | 28 | 29 | 30 | 32 | 119 |
| | | | | GRAND TOTAL | 369 |

IMAGE PRODUCING APPARATUS

BACKGROUND OF THE INVENTION

1. Field of the Invention

This invention relates to an image producing apparatus such as a printing machine, a copying machine and a printer, and, more particularly, to control functions for such an image producing apparatus.

2. Description of the Prior Art

Recently, more image producing apparatuses have been installed in educational institutions as well as in business firms. Some schools have operators dedicated to operating such image producing apparatuses. However, most copying or printing jobs are carried out by teachers.

A variety of documents are copied or printed in the school. For instance, contents of copied or printed papers may be different in each class (class newspapers), may be different in grades (e.g., examination papers), or may be the same throughout the school (e.g., PTA newspaper).

In order to copy or print the foregoing papers, it is necessary to know the number of students per class, the number of students per grade, and the total number of students in the school. For instance, in the case of copies or prints whose contents differ for every grade or whose contents are the same throughout the school, copied or printed sheets should be stacked for respective classes according to the number of students per class.

Thus, a table is usually shown in the vicinity of a copying or printing machine, which indicates the number of students per grade and per class in the shape of a matrix. Referring to the table, a teacher enters and registers the number of student data in the copying or printing machine, thereby producing a desired number of copies or prints. When obtaining the desired copies or prints, he or she inserts a slip sheet or the like in order to discriminate previous copies or prints from succeeding ones. Then, he or she starts producing new copies or prints.

Therefore, copying or printing may be usually performed with reduced efficiency. Further, the foregoing table is indispensable.

There has been an image producing apparatus which provides a class mode and a memory mode as well as an ordinary mode. The class mode is selected when producing a plurality of sets of copies or prints, each set having the same number of sheets. The memory mode can store a plurality of set numbers indicating different quantities of copies or prints to be produced. However, when the image producing apparatus is used in a school where respective classes are different from one another in the number of students, the class mode cannot be used. Further, since a number of teachers may operate the image producing apparatus one after another, it is troublesome to remember memory numbers in which respective classes are stored. In particular the class mode or memory mode is difficult and complicated to operate.

SUMMARY OF THE INVENTION

The invention is designed to overcome the foregoing problems of the prior art and is intended for providing an image producing apparatus with control functions which enhance operability and efficiency when used in school.

According to a first aspect of the invention, there is provided an image producing apparatus which includes a control panel with a keypad, and is capable of selecting a school mode in which keys on the keypad are pressed for selecting at least a particular class or grade, and numerical data concerning the number of students in each selected class or grade are extracted and registered as the number of prints.

In a second aspect of the invention, there is provided an image producing apparatus which includes a control panel with a keypad and a liquid crystal display, and is capable of selecting a school mode in which the liquid crystal display indicates, in the form of a matrix, numerical data concerning the number of students per class or per grade, one or a plurality of numerical data are extracted by a selection key, and the numerical data are registered as the number of prints.

According to any of the foregoing arrangements, when printing is performed for a plurality of classes or grades in the school mode, printed sheets are sorted in accordance with each class and grade.

Printing is performed first for a class having the largest class-grade identification code and is completed for a class having the smallest class-grade identification code, and printed sheets are discharged from the image producing apparatus in accordance with a printed order.

The keypad has numeric or alphanumeric keys. The control panel has a selector for selecting either a numeric or alphanumeric indication, and a display for indicating data in either numeric or alphanumeric form.

The control panel further includes a plus-1 key for registering the numerical data with one added.

In accordance with a third aspect of the invention, there is provided an image producing apparatus which includes a control panel with a liquid crystal display which indicates classes and grades in boxes, and is capable of selecting a school mode in which numerical data concerning the number of students in the selected boxes are registered as the number of prints when one or a plurality of boxes are selected by a selection key.

In the third aspect, when printing is performed for a plurality of classes or grades in the school mode, printed sheets are sorted in accordance with each class and grade.

According to a fourth aspect of the invention, there is provided an image producing apparatus which includes: data extracting means for extracting data concerning identification codes and numerical data concerning the number of members belonging to the respective identification codes, the numerical data being changeable; and a display for indicating the identification codes and the numerical data. The image producing apparatus is capable of selecting a special mode in which the numerical data are registered as the number of prints.

BRIEF DESCRIPTION OF THE DRAWINGS

The present invention will become more fully understood from the detailed description given below and the accompanying drawings which are given by way of illustration only, and thus are not limiting of the present invention. In all Figures, identical parts have identical reference numbers.

DESCRIPTION OF THE PREFERRED EMBODIMENTS

Figure 7:
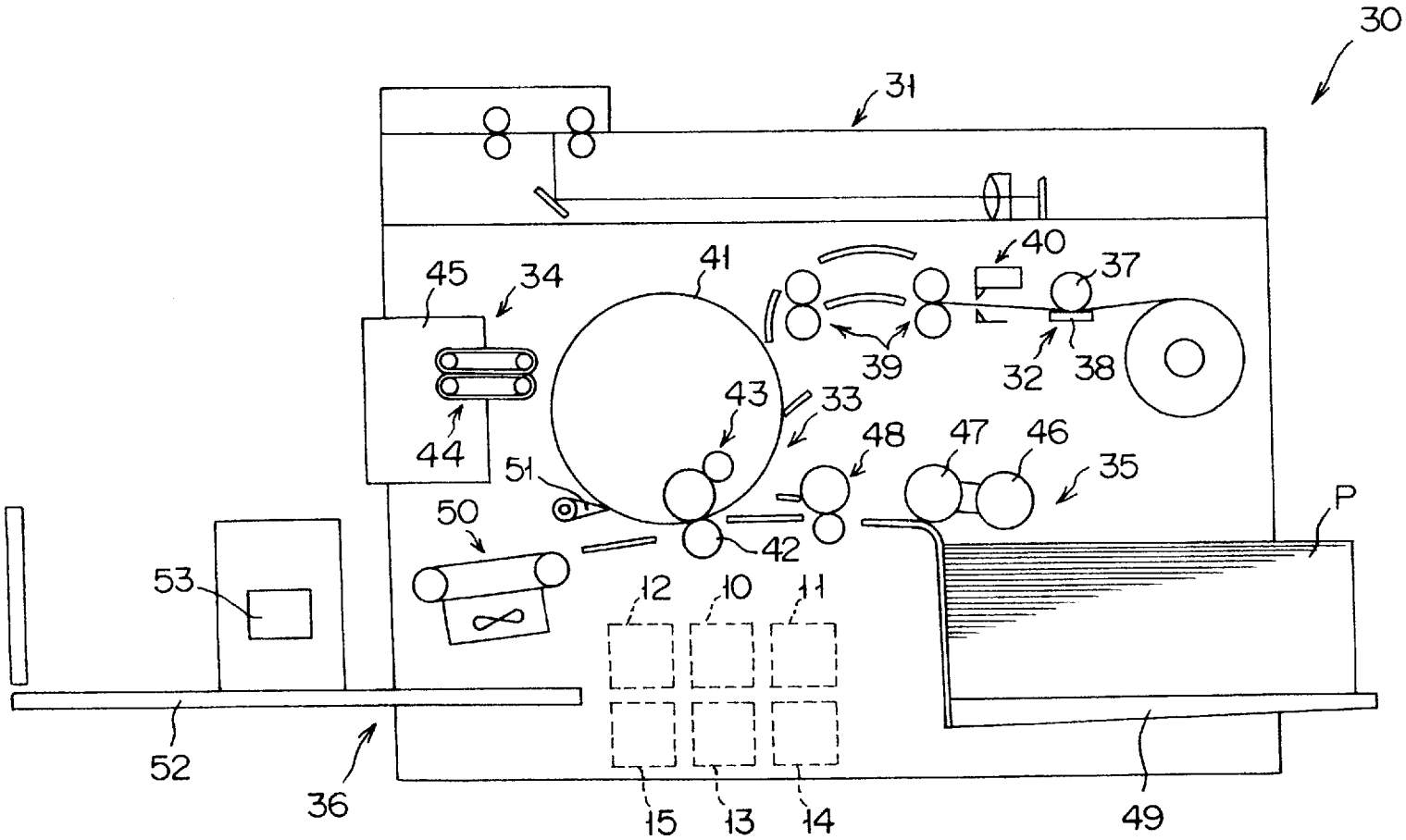
FIG. 7 schematically shows a stencil duplicating machine to which the invention is applied.

FIG. 7 shows an image producing apparatus, e.g., a stencil duplicating machine 30, to which the invention is applied. The stencil duplicating machine 30 has a well-known structure, and can select a class mode, a memory mode and so on as well as an ordinary mode. The stencil duplicating machine 30 mainly comprises a document reader 31, a stencil perforating section 32, a printing section 33, a stencil take-up section 34, a sheet feeding section 35, and a printed sheet discharging section 36.

The document reader 31 is present atop the stencil duplicating machine 30. The stencil perforating section 32 includes a platen roller 37, a thermal head 38, a pair of sheet feed rollers 39, a stencil cutter 40 and so on. The printing section 33 includes a printing drum 41, a press roller 42, an ink supply 43 and so on. The stencil take-up section 34 includes a stencil take-up unit 44, a used stencil receptacle 45, and so on. The sheet feeding section 35 includes a sheet feed roller 46, a separating roller 47, a pair of register rollers 48, a sheet tray 49 for stacking printing sheets P thereon, and so on. The printed sheet discharging section 36 includes a printed sheet conveyor 50, a separating claw 51, a printed sheet tray 52, a tape cutter 53, and so on.

The stencil duplicating machine 30 also comprises a control unit 10, an image data processing unit 11, a storage 12, a main motor driver 13, a stencil perforation driver 14, a stencil take-up driver 15, and so on, all of which are positioned at a lower part in the machine 30.

The main motor driver 13 controls the operation of the printing drum 41, the press roller 42, the sheet feed roller 46, the register roller pair 48, the printed sheet conveyor 50, and the tape cutter 53. The stencil perforation driver 14 controls the operation of the platen roller 37, the thermal head 38, the feed roller pair 39, and the stencil cutter 40. The stencil take-up driver 15 controls the operation of the stencil take-up unit 44.

Figure 1:
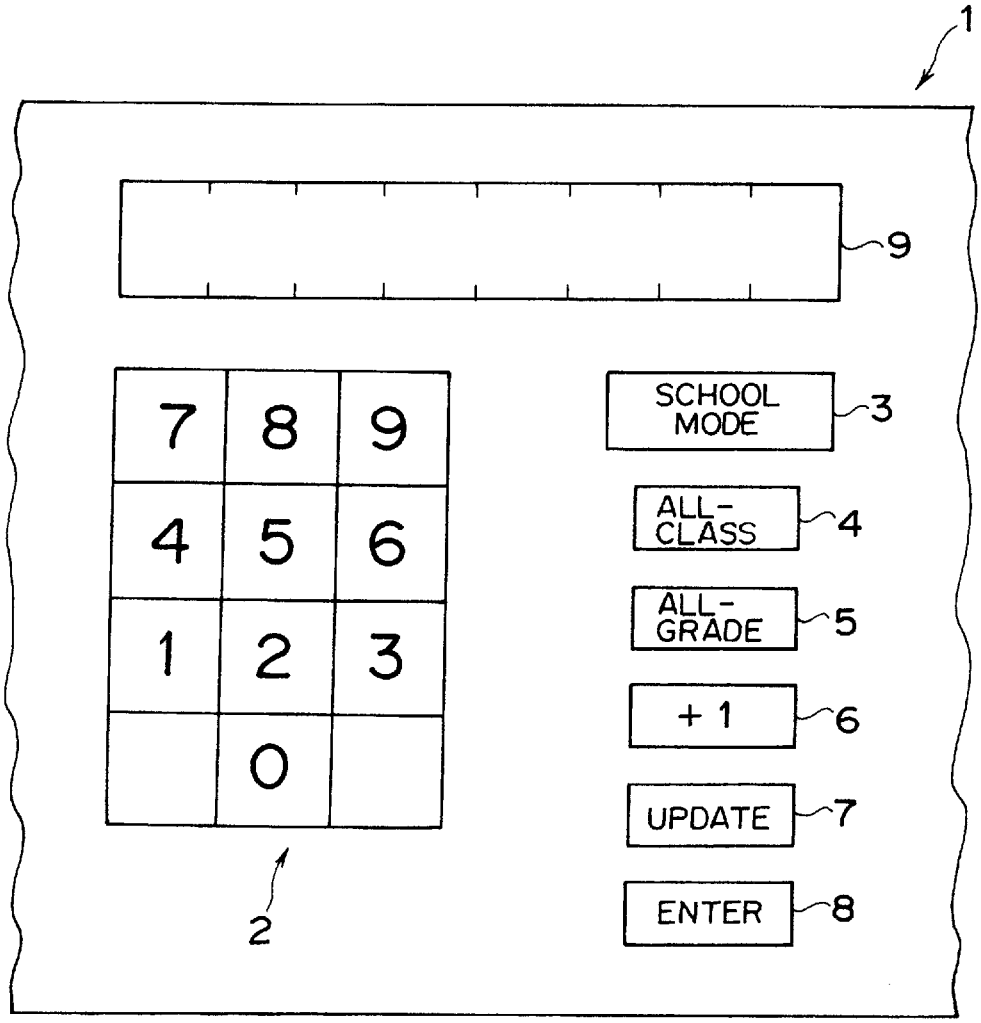
FIG. 1 shows a control panel of an image producing apparatus to which a first embodiment of the invention is applicable.

FIG. 1 shows part of a control panel 1 of the stencil duplicating machine 30 in the first embodiment. The control panel 1 is positioned on a top panel of the stencil duplicating machine 30, and includes operation keys such as a stencil perforation start key, a print start key, a trial print key and a stop key (which are not shown), a variety of mode setting keys (not shown), a numeric keypad 2 as a data extracting member, a school mode key 3 (as a special mode selecting key), an all-class key 4, an all-grade key 5, a (+1) key 6, an update key 7, an enter key 8, and an 8-digit LED display 9 for indicating each digit in seven segments. The control panel 1 is connected to the control unit 10.

Figure 2:
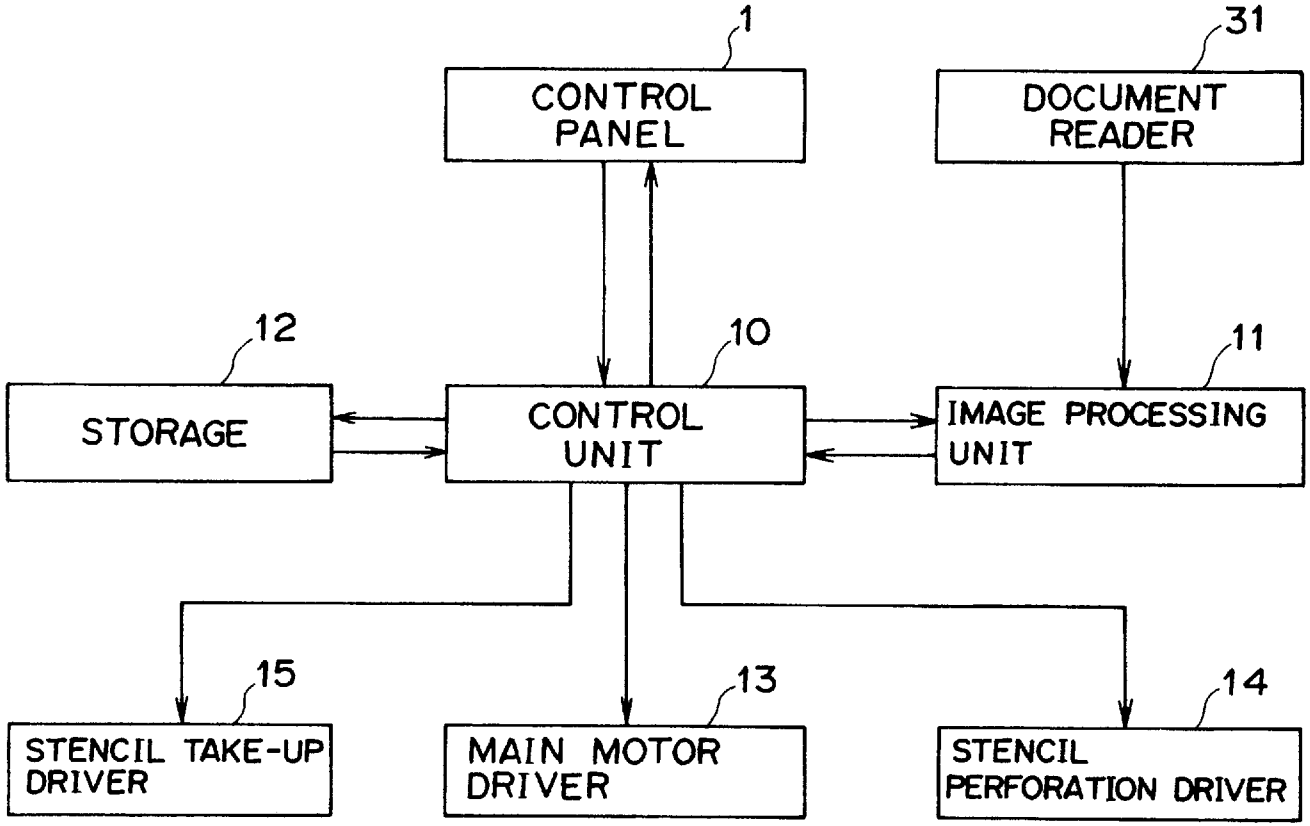
FIG. 2 is a block diagram of a control unit of the image producing apparatus.

The control unit 10 of the stencil duplicating machine 30 is constituted by circuit blocks as shown in FIG. 2, and is a well-known microcomputer mainly including a CPU, a ROM, and a RAM.

The control unit 10 receives not only an image data signal, which is read by the document reader 31 and undergoes analog/digital conversion and other processing by the image processing unit 11, but also an operation signal and a data signal from the control panel 1. The control unit 10 provides indication data to the control panel 1. In response to these signals, the control unit 10 starts an operation program of the stencil duplicating machine 30, stored in the storage 12, and issues operation commands to the main motor driver 13, stencil perforation driver 14 and stencil take-up driver 15. The drivers 13, 14 and 15 actuate their related actuators. The stencil duplicating machine 30 then performs a series of operations, i.e., perforates a stencil, feeds sheets, prints sheets, feeds printed sheets, and takes up a used stencil.

Figures 3, 4:
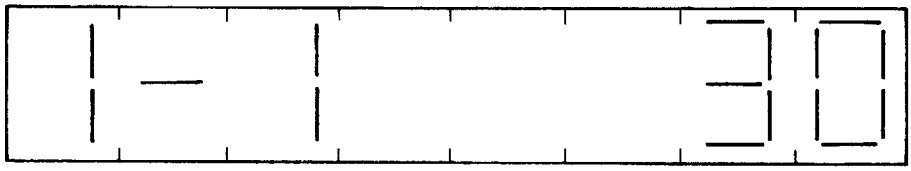
FIG. 3 is a table showing number-of-student data.
FIG. 4 shows an image on the display.

The storage 12 stores not only programs for operating the actuators of the main motor driver 13, stencil perforation driver 14, and stencil take-up driver 15 but also numerical data concerning the number of students per class in a school mode, as shown in FIG. 3. The programs are prepared for a plurality of printing conditions. The storage 12 stores the number of students per class at each address. For example, "30" for Class 1-1 is stored at an address 1, and "28" for Class 1-2 at the address 2.

In operation, an operator places an original on the document reader 31, and presses the stencil perforation start key (not shown) on the control panel 1. Image data read by the document reader 31 are converted by the image data processing unit 11, and are supplied to the control unit 10 as the image data signal. Simultaneously, the operation commands for the stencil take-up and stencil perforation are provided to the stencil duplicating machine 30 by the control unit 10.

In response to these signals, the control unit 10 supplies the operation commands to the main motor driver 13, stencil perforation driver 14, and stencil take-up driver 15, respectively. The stencil take-up unit 44 is operated so as to peel an existing used stencil from a surface of the printing drum 41. The peeled stencil is discharged into the used stencil receptacle 45. In response to the image data signal from the image data processing unit 11, the control unit 10 heats heat emitting elements of the thermal head 38 so that a new stencil is perforated. In this state, both the platen roller 38 and a pair of stencil feed rollers 39 are operated. The perforated fresh stencil is wrapped on the outer surface of the printing drum 41 which is free from the used stencil. Thus, the stencil duplicating machine 30 finishes the stencil take-up and stencil perforation operations, and is ready for a printing operation.

The printing operation in the school mode will be described hereinafter. When the stencil duplicating machine 30 is ready for the printing operation, the operator presses the school mode key 3 on the control panel 1. In response to the operation signal from the control panel 1, the control unit 10 calls the operation program for establishing the school mode. The school mode key 3 will be pressed again in order to cancel the school mode.

It is assumed here that Class 1-1 will be selected. First of all, the operator presses a numeric key "1" twice on the numeric keypad 2, thereby selecting Class 1-1. A data signal indicative of selected Class 1-1 is sent to the control unit 10. In response to this data signal, the control unit 10 calls a number-of-student data (i.e., numerical data) "30" (i.e., the number of students in a hypothetical class) from the address 1 associated with Class 1-1 in the storage 12. On the control panel 1, the display 9 indicates a message "1-1 30" as shown in FIG. 4. Thus, "30" is registered as the number of prints to be produced.

The operator then presses the print start key (not shown) on the control panel 1. The operation signal is sent to the control unit 10 from the control panel 1. The control unit 20 issues the operation command to the main motor driver 13. This operation command activates the sheet feed roller 46, the register roller pair 48, the printing drum 41, the press roller 42, and the printed sheet conveyor 50. Print sheets P from the sheet feeding section 35 have an image printed thereon, are transported by the printed sheet conveyor 50 to the printed sheet tray 52, and are stacked thereon. The printed sheet tray 52 is present outside the stencil printing machine 30. When counters (not shown) in the printing section 33 and the sheet feeding section 35 count the registered number of printed sheets, the control unit 10 provides a stop signal to the main motor driver 13, thereby interrupting the printing operation.

In the foregoing operation, if numeric keys "1" and "2" are erroneously pressed on the numeric keypad 2 instead of pressing the numeric key "1" twice for selecting Class 1-1, the display 9 will indicate a message "1-2 28". In such a case, the school mode key 3 is pressed so as to temporarily cancel the school mode. Then, the school mode key 3 is pressed again, and the correct numeric key "1" is pressed twice on the numeric keypad 2 in order to select Class 1-1. Alternatively, it is also possible to press a clear key (not shown), and restart the procedure from the beginning.

The following describe the operation for producing prints for Classes 1-1 to 1-4 in the first grade, with reference to FIGS. 1 and 3.

The operator presses the numeric key "1" on the numeric keypad 2, and the all-class key 4. The data signal and the operation signal indicative of this state are sent to the control unit 10. In response to these signals, the control unit 10 calls, from the storage 12, the number-of-student data "31" for Class 1-4, and provides the indication data to control panel 1. On the control panel 1, the display 9 indicates a message "1-431". Thus, "31" is registered as the number of prints to be produced.

Thereafter, the operator presses the print start key (not shown). The operation signal is sent to the control unit 10 from the control panel 1. The operation command from the control unit 10 activates the sheet feed roller 46, the register roller pair 48, the printing drum 41, the press roller 42, and the printed sheet conveyor 50. Thus, the stencil printing machine 30 keeps on producing prints until the counters in the printing section 33 and the sheet feeding section 35 count the registered number of prints. When the printed sheets reach the registered number, the control unit 10 issues the operation command. In response to the operation command, the tape cutter 53 operates so as to cut a tape and stick it onto the top of printed sheets on the printed sheet tray 52. Concurrently, the control unit 10 issues the stop signal to the main motor driver 13, so that the printing operation is temporarily interrupted.

After the temporary interruption of the printing operation, the control unit 10 calls, from the storage 12, the number-of-student data "32" for Class 1-3. On the control panel 1, the display 9 indicates a message "1-3 32". "32" is registered as the number of prints to be produced. The printing operation is repeated until 32 printed sheets are obtained. When the desired number of printed sheets is obtained, the tape cutter 53 operates. Then, the printing operation will be temporarily interrupted.

The control unit 10 then calls, from the storage 12, the number-of-student data "28" for Class 1-2. The display 9 indicates a message "1-2 28". "28" is registered as the number of prints to be produced. The tape cutter 53 operates when the stencil duplicating machine 30 produces 28 prints. Thus, the printing operation is temporarily interrupted. Thereafter, the control unit 10 calls, from the storage 12, the number-of-student data "30" for Class 1-1. The display 9 indicates a message "1-1 30". "30" is registered as the number of prints to be produced. The printing operation is continued until 30 prints are produced. Then, the whole printing operation will be completed.

The printed sheet tray 52 houses a total of 121 printed sheets, i.e. the 30 printed sheets for Class 1-1, the 28 printed sheets for Class 1-2 with the cut tape, the 32 printed sheets for Class 1-3 with the cut tape, and the 31 printed sheets for Class 1-4 with the cut tape are stacked on top of each other. The 30 printed sheets for Class 1-1 are at the top . . . , and the 31 printed sheets for Class 1-4 at the bottom on the printed sheet tray 52.

In order to produce prints for all the classes in the second grade, the numeric key "2" is pressed on the numeric keypad 2, followed by the all-class key 4 and the print start key. The printing operation will be performed as described above. The numeric keys "3" will be pressed on the numeric keypad 2 in order to produce prints for the classes in the third grade. The all-class key 4 and the print start key will be then pressed.

It is assumed here that prints will be produced for all the classes (e.g. classes 1-1 to 3-4) in the first to third grades throughout the school.

The operator presses the all-grade key 5. The operation signal indicative of this is sent to the control unit 10. In response to the operation signal, the control unit 10 calls, from the storage 12, the number-of-student data "32" for Class 3-4 (shown in FIG. 3), and provides the indication data to the control panel 1. On the control panel 1, the display 9 indicates a message "3-4 32". "32" is registered as the number of prints to be produced.

Thereafter, the print start key will be pressed, so that prints will be sequentially produced from Class 3-4, Class 3-3, . . . to Class 1-1. When the prints for Class 1-1 are obtained, the printing operation will be completed. The printed sheet tray 52 houses a total of 369 printed sheets, i.e., the 30 prints for Class 1-1, the 28 prints for Class 1-2, . . . , the 32 prints for Class 3-4 are stacked thereon with the tapes interposed between the prints for the respective classes. In this case, the prints for Class 3-4 are at the bottom, . . . , and those for Class 1-1 are at the top.

The (+1) key 6 is operated in order to produce the registered number of prints (in accordance with the number-of-student data for each class stored in the storage 12) and one additional print. When the (+1) key 6 is pressed, the control unit 10 always calls, from the storage 12, the number-of-student data added by one. Thus, prints will be produced with one extra print, which may be used for a teacher in charge of the class.

For instance, the operator presses the numeric key "1" twice on the numeric keypad 2, and the (+1) key 6, thereby selecting Class 1-1. The data signal and the operation signal indicative of this state are sent to the control unit 10. The control unit 10 then calls, from the storage 12, the number-of-student data "30" from the address 1 associated with Class 1-1. The control unit 10 provides "30" to the control panel 1, and adds "1" to the number-of-student data "30". On the control panel 1, the display 9 indicates the message "1-1 30", which is changed to a message "1-1 31" in response to the indication data from the control unit 10. This is because the (+1) key 6 has been pressed. Thus, "31" is registered as the number of prints to be produced. Following the print start key, the printing operation will be performed as described above.

It is assumed that the numeric key "1" on the numeric keypad 2, the all-class key 4 and the (+1) key 6 are pressed in succession. The control unit 10 calls, from the storage 12, the number-of-student data "31" for Class 1-4, and adds one to "31". On the control panel 1, the display 9 changes its message "1-4 31" to a message "1-4 32". Thus, "32" is registered as the number of prints to be produced.

The print start key is pressed, so that the printing operation is performed until the counters count the registered number "32". In response to the operation command from the control unit 10, the tape cutter 53 is activated and sticks a cut tape onto a top printed sheet on the printed sheet tray 52. The printing operation is temporarily interrupted. Thereafter, the control unit 10 calls, from the storage 12, the number-of-student data "32" for Class 1-3, and provides indication data "32+1" to the control panel 1. The display 9 indicates a message "1-3 33" on the control panel 1. Thus, "33" is registered as the number of prints to be produced. The printing operation is performed as described above until 33 prints are produced. The tape cutter 53 is then operated, and the printing operation is temporarily interrupted. Thereafter, the printing operation is performed to produce 29 (=28+1) prints for Class 1-2. Similarly, the printing operation is further performed to produce 31 (=30+1) prints for Class 1-1. Then, the printing operation will be completed.

It is also possible to increase the number of prints to be produced with an additional print only for a particular class. For example, if the (+1) key 6 is pressed while the display 9 indicates the message "1-4 31" after pressing the numeric key "1" on the numeric keypad 2 and the all-class key 4 in succession, the number of prints to be produced only for Class 1-4 can be increased to 32.

When the printing operation under the (+1) mode is completed for all the classes in the first grade, the printed sheet tray 52 houses a total of 125 prints thereon, i.e., the 31 prints for Class 1-1, a first tape, the 29 prints for Class 1-2, a second tape, the 33 prints for Class 1-3, a third tape, and the 32 prints for Class 1-4 are stacked on top of each other. The prints for Class 1-1 are at the top and those for Class 1-4 ate at the bottom on the printed sheet tray 52.

If the (+1) key 6 is used together with the all-grade key 5, "1" is added to each registered number of prints of all the classes throughout the school similarly to the printing operation with the all-class key 4 and the (+1) key 6 pressed in succession.

The number-of-student data can be updated as follows when there are some changes in the number of students.

First of all, the operator presses the school mode key 3 so as to set up the school mode. The update key 7 is then pressed. The control unit 10 calls, from the storage 12, the number-of-student data of Class 1-1, and provides the indication data to the control panel 1. On the control panel 1, the display 9 indicates the message "1-1 30". The value "30" blinks, which represents that the control unit 10 is ready for updating the number-of-student data. In this state, the operator presses the numeric keys "2" and "8" on the numeric keypad 2, and then presses the enter key 8. "28" blinks on the display 9. The enter key 8 is then pressed again, so that the number-of-student data of Class 1-1 is updated to "28".

Thereafter, the display 9 indicates the message "1-2 28". The value "28" blinks. If it is not necessary to change "28", the operator presses the enter key 8. The display 9 indicates the message "1-2 28" in a steady manner.

Next, the display 9 indicates the message "1-3 32". "32" blinks on the display 9. In this state, if necessary, the number-of-student data "32" will be updated in accordance with a new number of students in Class 1-3 in the similar manner to that mentioned above.

The update key 7 is pressed again after number-of-student data are updated. Thus, the stencil duplicating machine 30 goes out from the update mode, and resumes the school mode.

Further, it is also possible to update the number-of-student data of a particular class, e.g. Class 1-2, by pressing the update key 7 after pressing "1" and "2" on the numeric keypad 2.

Figure 5:
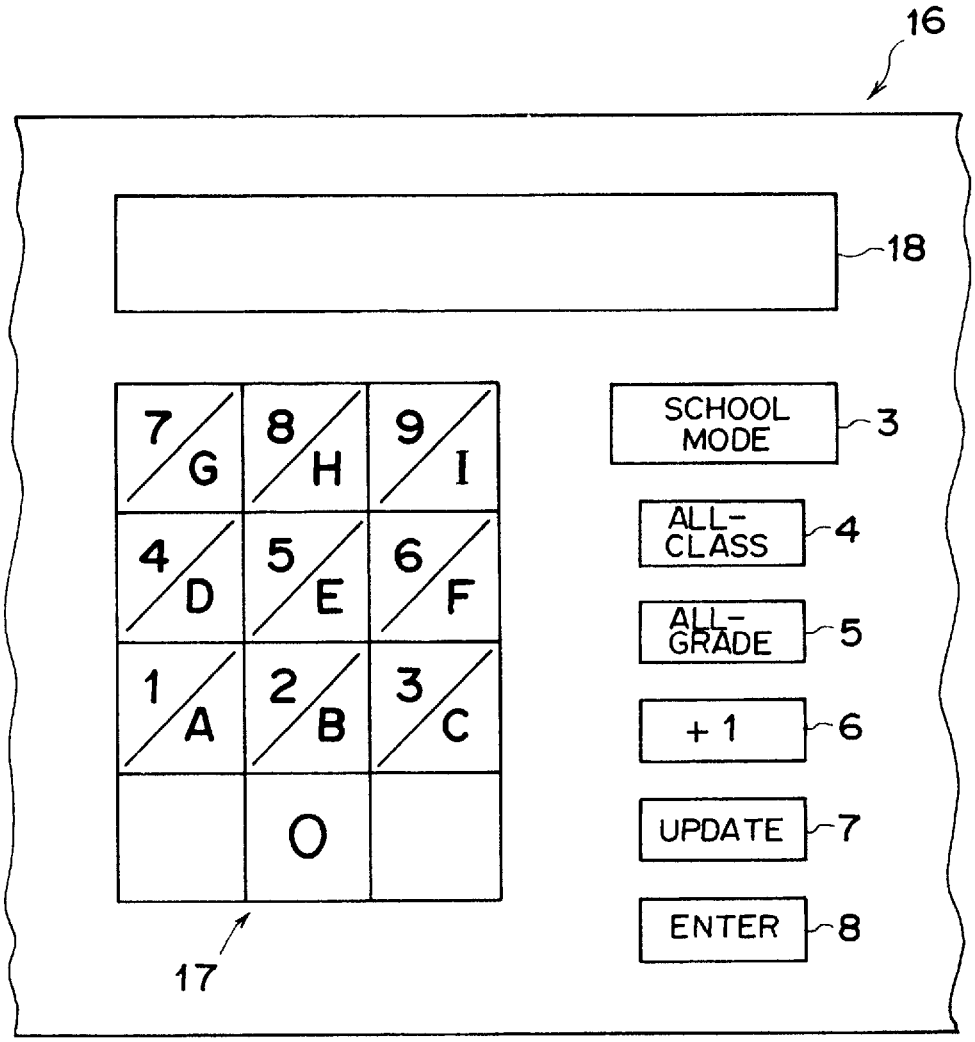
FIG. 5 shows a modified control panel in the first embodiment.

FIG. 5 shows a control panel 16 used in a modified example of the first embodiment. The control panel 16 is substantially identical to the foregoing control panel 1, but differs therefrom in the following points. Specifically, the control panel 16 includes an alphanumeric keypad 17, and a liquid crystal display 18 which can indicate letters as well as numerals.

Either numerals or letters can be selectively entered by operating a selector switch (not shown) of the stencil duplicating machine 30. Specifically, the control unit 10 controls the alphanumeric keypad 17 so that letters can be entered only to indicate the classes in the school mode.

When the selector switch is set to the letters, the operator presses alphanumeric keys "3/C" and "1/A". In response to data signal from the control panel 16, the control unit 10 recognizes that Class 3-A is designated, and calls the number-of-student data (e.g., 30) of the Class 3-A from the storage 12. The indication data is supplied to the control panel 16, which makes the liquid crystal display 18 indicate a message "3-A 30". The value "30" is registered as the number of copies or prints to be produced. The selector switch is operated in multiple steps in order to indicate all of the letters.

Figure 6:
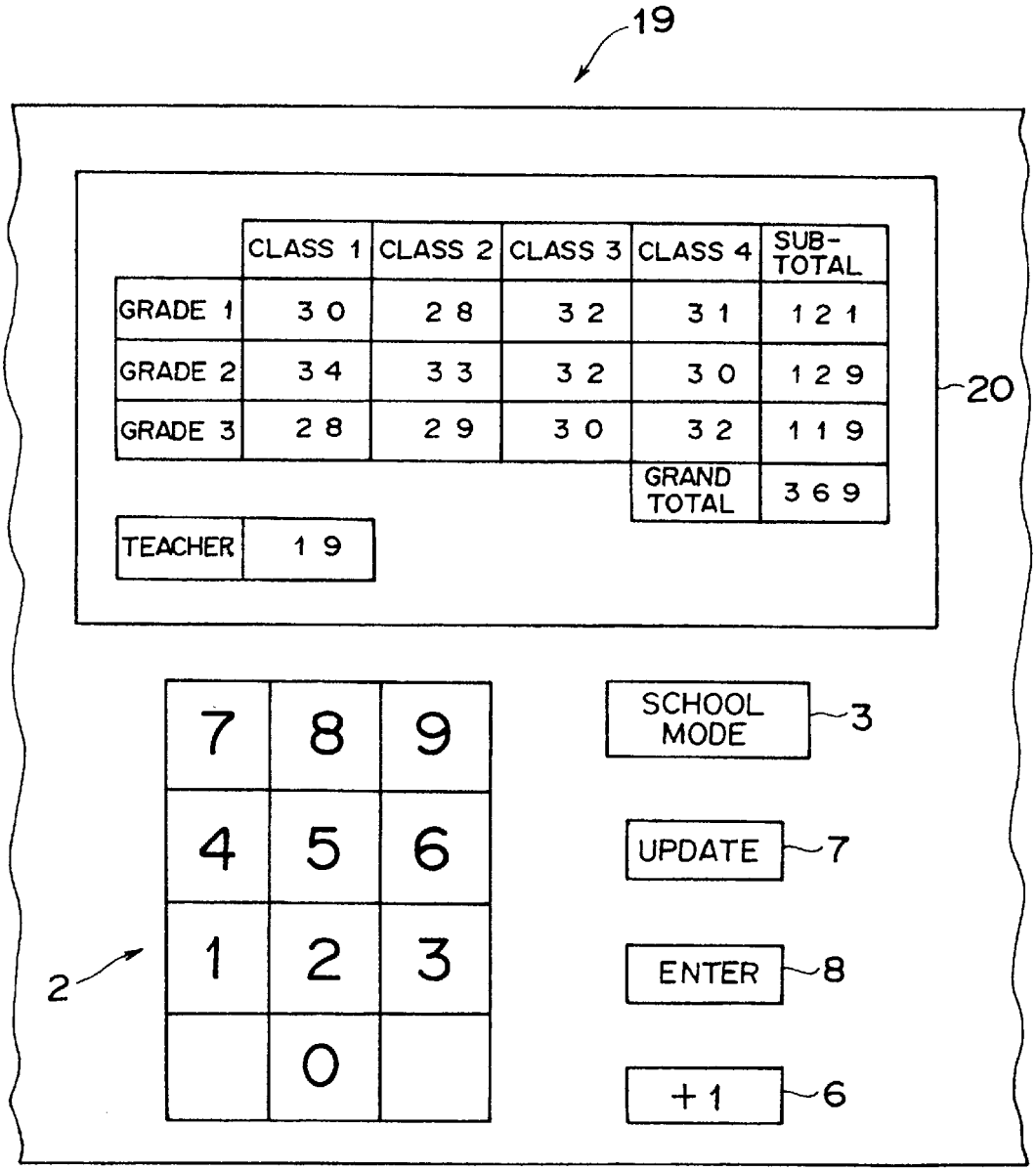
FIG. 6 shows a control panel in a second embodiment when a school mode is selected.

In a second embodiment of the invention, a control panel 19 in the school mode has an appearance as shown in FIG. 6. This control panel 19 is substantially identical to the control panel 1 in the first embodiment, but differs from the control panel 1 in that an LCD touch screen 20 is employed in place of the display 9.

The LCD touch screen 20 has a well-known structure. In the ordinary mode, the LCD touch screen 20 usually indicates the number of copies or prints to be produced, printing speed data, printing density data, and so on.

When the school mode key 3 is pressed, the control unit 10 issues the data indicative of the school mode and calls the number-of-student data from the storage 12. The number-of-student data are indicated in the form of a matrix on the LCD touch screen 20. Specifically, on the LCD touch screen, when touched, each box functions as a selection key as described hereinafter.

In operation, when producing prints for Class 1-1, the operator touches, on the LCD touch screen 20, a box "30" corresponding to Class 1-1. Then, the box "30" is indicated in reverse video on the LCD touch screen 20, so that "30" is registered as the number of prints to be produced. The operator presses the print start key. Thereafter, the stencil duplicating machine 30 produces prints as in the first embodiment.

The following describe a special case in which prints are produced for Class 1-1 and Class 3-2 in succession.

The operator touches boxes "30" and "29" for these classes in turn. The boxes "30" and "29" are indicated in reverse video on the LCD touch screen 20. The number-of-student data "30" and "29" are registered as the number of prints to be produced. The print start key is pressed, so that the stencil duplicating machine 30 produces 29 prints for Class 3-2. The 29 prints are stacked on the printed sheet tray 52 with a tape stuck on the top sheet. After temporarily suspending its operation, the stencil duplicating machine 30 resumes producing 30 prints for Class 1-1.

When it is necessary to successively produce prints for a plurality of classes, the printing operation will be started for a class having the largest class-grade identification code first and be repeated for the remaining classes one after another. This means that the prints for the class whose class-grade identification code is the smallest is atop the prints for the other classes on the printed sheet tray 52, which facilitates sorting.

In order to obtain prints for all the students in the first grade, the operator touches the box "121" indicative of a sub total. The box "121" is then indicated in reverse video, so that "121" is registered as the number of prints to be produced. Thereafter, the print start key is pressed, and the box "31" related to Class 1-4 is indicated in reverse video. When 31 prints are produced, a tape is stuck on the top sheet, and the printing operation will be temporarily suspended.

The box "31" returns to normal video. Then, the box "32" related to Class 1-3 is indicated in the reverse video. After producing 32 prints, a tape is stuck onto the top sheet, and the printing operation is temporarily suspended. Prints for Classes 1-2 and 1-1 will be produced in a similar manner. The box "121" remains in reverse video until all of 121 prints are obtained. When all the printing operation is complete, the box "121" returns to normal video.

Prints for all the students throughout the school will be produced in the following manner. The operator touches the grand total box "369" on the LCD touch screen 20, so that this box is indicated in reverse video. The number-of-student data "369" is registered as the number of prints to be produced. The print start key is pressed. The box "32" related to Class 3-4 is indicated in reverse video. After producing 32 prints, a tape is attached to the top sheet. Then, the printing operation is temporarily suspended. The box "32" returns to normal video.

The foregoing operation is repeated until 30 prints are produced for the Class 1-1. During the printing operation, the box "369" remains in reverse video. When all of 369 prints are obtained, the box "369" returns to normal video.

The printing operation with the (+1) key 6 will be performed as follows. The operator touches the box "30" for the Class 1-1 on the LCD touch screen 20. When the (+1) key 6 is pressed after the box "30" is indicated in reverse video, an operation signal indicative of this is supplied to the control unit 10. Thus, the control unit 10 updates the number-of-student data "30" to "31". The data "31" is registered as the number of prints to be produced. The sub-total "121" is updated to "122". Thereafter, the print start key is pressed to produce prints as described above.

It is assumed here that the (+1) key 6 is pressed after touching the sub-total box "121". The operation signal indicative of the operation of the (+1) key 6 is supplied to the control unit 10. The control unit 10 updates the number-of-student data "121" to "125". The box "125" is indicated in reverse video. Thus, "125" is registered as the number of prints to be produced. The number-of-student data "30", "28", "32" and "31" (related to the classes in the first grade) are respectively updated to "31", "29", "33" and "32". When the print start key is pressed, the box "32" for Class 1-4 is indicated in reverse video. Thereafter, the printing operation will be performed as described previously.

When the (+1) key 6 is pressed after the grand total box "369" is touched and is indicated in reverse video, one (1) is added to every class throughout the school. The number-student-data each with plus 1 are registered as the number of prints to be produced.

The stored data will be updated as described hereinafter. First of all, the school mode is selected by the school mode key 3. The update key 7 is then pressed. The control unit 10 provides the indication data to the control panel 19. On the LCD touch screen 20, the box "30" for Class 1-1 is indicated in the reverse video, which makes the control unit 10 ready for receiving new number-of-student data for Class 1-1. In this state, the operator presses the numeric keys "2" and "8" on the numeric keypad 2, and the enter key 8. The box "30" is changed to "28" on the LCD touch screen 20. When the enter key 8 is pressed again, the number-of-student data "30" is updated to "28", and the box "28" returns to normal video.

Next, the box "28" for Class 1-2 is indicated in the reverse video. If no change is necessary, the operator presses the enter key 8 without pressing any numerical key on the numeric keypad 2. The box "28" returns to normal video.

The box "32" related to Class 1-3, and the box "31" for Class 1-4 are indicated in the reverse video in succession as described above. In this state, the update key 7 is pressed, so that the update mode is completed, and the school mode is resumed. Needless to say, the number-of-student data of a particular class can be updated as in the first embodiment.

In the second embodiment, it is possible to selectively enter numerals or alphabets using the alphanumeric keypad 17 (shown in FIG. 5) and the selector switch (not shown) provided in the stencil duplicating machine 30.

Figure 8:
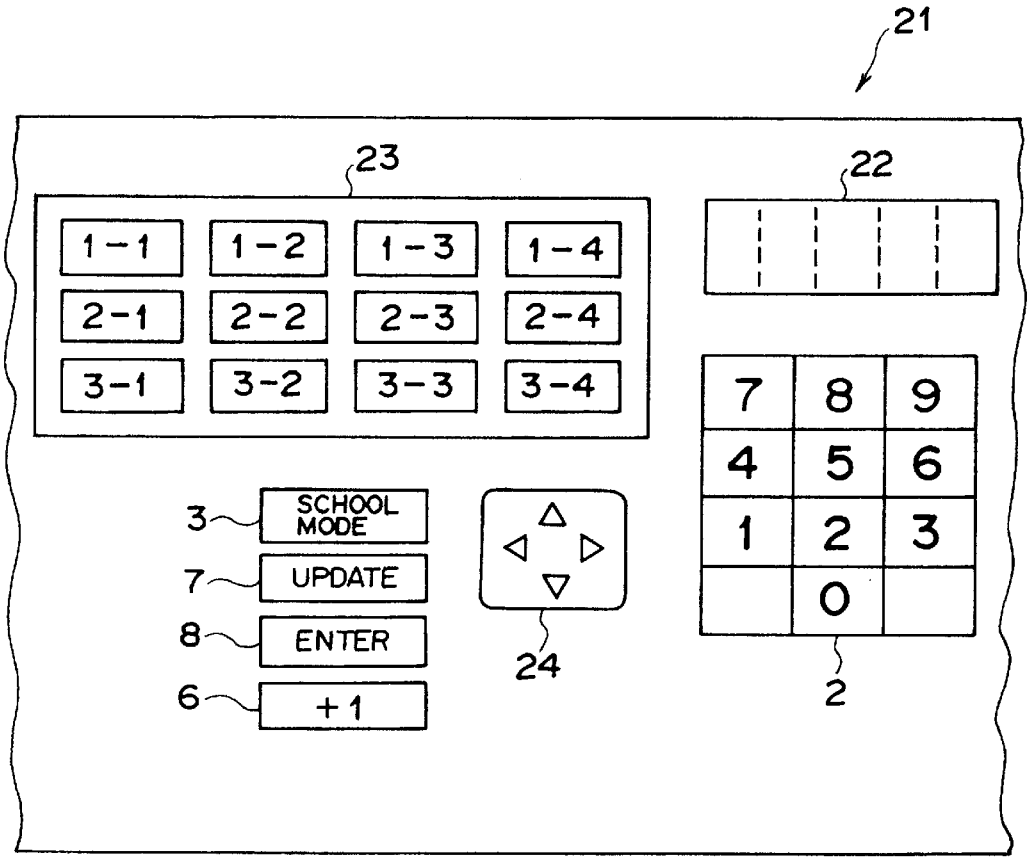
FIG. 8 shows a control panel in a third embodiment when the school mode is selected.

FIG. 8 shows a control panel 21 used for the school mode in a third embodiment of the invention. The control panel 21 differs from the control panel 19 (shown in FIG. 6) only in that it includes a 5-digit-7-segment LED 22, a liquid crystal display 23 and a scroll key 24 as a data extracting member.

The liquid crystal display 23 can indicate data in approximately three rows, but does not have the touch-screen function. Thus, the display 23 is less expensive than the LCD touch screen 20. The display 23 usually indicates data such as a printing speed and operating states of the printing machine.

Referring to FIG. 8, when the school mode key 3 is pressed, the liquid crystal display 23 indicates a plurality of boxes having grade-class data. First of all, the box related to data stored at the first address (e.g. "1-1" denoting the class 1 in the first grade) is indicated in reverse video. Each time the scroll key 24 is pressed, each box is indicated in reverse video one after another in accordance with a direction of a pressed mark on the scroll key 24. When the enter key 8 is pressed after a box of the desired class (e.g., "1-3") is indicated in reverse video, the 7-segment LED 22 indicates the number-of-student data "32" (which is changeable) for Class 1-3. The data "32" is confirmed. In this state, the print start key is pressed, so that 32 prints will be produced.

The following describes how prints for Classes 1-1 to 1-4 are produced and stacked. First of all, the box "1-1" is selected by operating the scroll key 24, and is indicated in reverse video. The enter key 8 is pressed, so that the 7-segment LED 22 indicates the number-of-student data "30". Next, the scroll key 24 is pressed so as to select the box "1-2" and indicate it in reverse video. In this state, since "30" for Class 1-1 has been confirmed, the box "1-1" remains in reverse video. When the enter key 8 is pressed, the 7-segment LED 22 then changes its indication "30" to "28". Similarly, the boxes "1-3" and "1-4" are indicated in reverse video, and the number-of-student data of these classes are confirmed by pressing the enter key 8. Finally, the print start key will be pressed, so that 31 prints for Class 1-4, 32 prints for Class 1-3, 28 prints for Class 1-2, and 30 prints for Class 1-1 are automatically produced and stacked on the printed sheet tray 52 in the foregoing order.

In the foregoing confirming process, it is also possible to extract the number-of-student data of only the desired classes by pressing the scroll key 24 and by skipping unnecessary number-of-student data without pressing the enter key 8.

Figure 9:
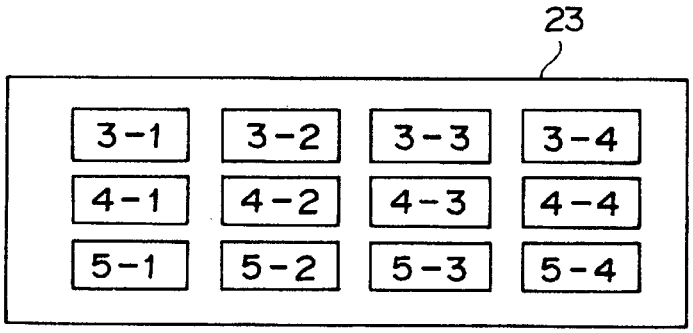
FIG. 9 shows messages indicated on a liquid crystal display in the third embodiment.
Figure 10:
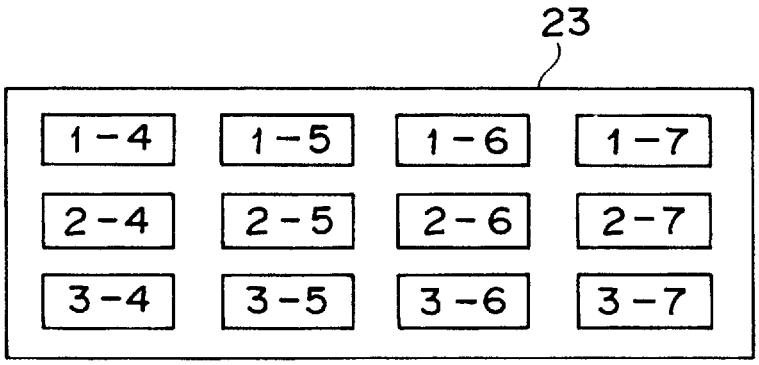
FIG. 10 shows other messages indicated on the liquid crystal display in the third embodiment.

The liquid crystal display 23 has the boxes arranged only in three rows. In order to indicate the number-of-student data stored for all the classes as shown in FIG. 9 or FIG. 10, the scroll key 24 is pressed at its lower part while the box "3-1", "3-2", "3-3" or "3-4" remains in reverse video, or while the box "1-4", "2-4" or "3-4" remains in reverse video on the leftmost column.

In this embodiment, it is also possible to indicate the classes with "1-A", "1-B" and so on by selectively operating the selector switch as in the modified example of the first embodiment, or to indicate data such as "All classes in grade 1", or "All classes throughout school".

In the foregoing embodiments, the image producing apparatus is assumed to be applied to an institution such as school. When producing prints in such an institution, the number-of-student data, which are stored in the addresses (of the storage) corresponding to the identification codes in accordance with classes and grades in the school, are selectively extracted from the storage, and are registered as the number of prints to be produced. Such data can be updated in accordance with any change in classes or grades. However, the invention is also applicable to a firm, a company or the like. In such a case, number-of-employee data in sections and departments may be used to register the number of prints to be produced in a special mode in place of the foregoing school mode.

The invention is applicable to an electrophotographic copying machine as well as the stencil duplicating machine.

According to the invention, when the image producing apparatus is used in the school mode, the number-of-student data stored therein is selectively extracted and is registered as the number of prints to be produced. Thus, the desired number of prints or copies can be obtained in accordance with the number-of-student data. This is effective in improving the efficiency of the printing or copying operation and in reducing a printing or copying cost.

What is claimed is:

1. An image producing apparatus comprising:

a control panel with a keypad;

at least three modes of operation;

mode selection means for selecting a school mode of operation in which keys on the keypad are pressed for selecting at least a particular class or grade;

means for extracting from a memory numerical data concerning a number of students in each selected class or grade;

means for registering the numerical data as a number of prints;

wherein when printing is performed for a plurality of classes and grades in the school mode, printed sheets are sorted in accordance with each class and grade.

2. An image producing apparatus comprising:

a control panel with a liquid crystal display touch screen which indicates classes and grades in boxes;

at least three modes of operation;

mode selection means for selecting a school mode of operation in which the liquid crystal display touch screen indicates, in the form of a matrix, numerical data concerning the number of students per class or per grade;

means for extracting one or a plurality of numerical data by touching boxes on the liquid crystal display touch screen;

means for registering the numerical data as a number of prints;

wherein when printing is performed for a plurality of classes and grades in the school mode, printed sheets are sorted in accordance with each class and grade.

3. The image producing apparatus according to claim 1 or 2, wherein printing is performed first for a class having the largest class-grade identification code and is completed for a class having the smallest class-grade identification code, and printed sheets are discharged from the image producing apparatus in accordance with a printed order.

4. The image producing apparatus according to claim 1 or 2, wherein the keypad has numeric or alphanumeric keys, the control panel has a selector for selecting either a numeric or alphanumeric indication, and a display for indicating data in either numeric or alphanumeric form.

5. The image producing apparatus according to claim 1 or 2 wherein the control panel further includes a plus-1 key for registering the numerical data with one added.

6. An image producing apparatus comprising a control panel with a liquid crystal display which indicates classes and grades in boxes;

at least three modes of operation;

mode selection means for selecting a school mode of operation in which when one or a plurality of boxes are selected by a selection key, numerical data concerning the number of students in the selected boxes are registered as the number of prints;

wherein when printing is performed for a plurality of classes and grades in the school mode, printed sheets are sorted in accordance with each class and grade.

7. An image producing apparatus comprising:

a control panel with a keypad;

at least three modes of operation:

mode selection means for selecting a special mode of operation;

means for extracting from a memory numerical data defined by first and second parameters, and the numerical data representing quantity and being updatable;

a display for indicating the first and second parameters and the numerical data;

means for registering the data as a number of prints;

wherein when printing is performed in the special mode for a plurality of groups defined by said first and second parameters, printed sheets are sorted in accordance with both first and second parameters.

8. An image producing apparatus according to claim 1, further comprising an all-class key for selecting all of the classes in a particular grade, wherein when printing is performed after the all class key is selected, printed sheets are sorted in accordance with each class in the grade.

9. An image producing apparatus according to claim 8, further comprising an all-grade key for selecting all of the classes in all of the grades.

10. An image producing apparatus according to claim 2, further comprising a sub total box for selecting all of the classes in a particular grade, wherein when printing is performed after the sub total box is selected, printed sheets are sorted in accordance with each class in the grade.

11. An image producing apparatus according to claim 10, further comprising a grand total box for selecting all of the classes in all of the grades.

12. An image producing apparatus according to claim 6, further comprising a sub total box for selecting all of the classes in a particular grade, wherein when printing is performed after the sub total box is selected, printed sheets are sorted in accordance with each class in the grade.

13. An image producing apparatus according to claim 12, further comprising a grand total box for selecting all of the classes in all of the grades.

* * * * *

UNITED STATES PATENT AND TRADEMARK OFFICE

CERTIFICATE OF CORRECTION

PATENT NO. : 5,881,336
DATED : March 9, 1999
INVENTOR(S) : Mitsuo Sato

It is certified that error appears in the above-identified patent and that said Letters Patent is hereby corrected as shown below:

Title page, item [57], Abstract, line 5, change "and" to --or--.

Column 7, line 40, change "ate" to --are--;

Signed and Sealed this

Fourteenth Day of November, 2000

*Attest:*

Q. TODD DICKINSON

*Attesting Officer*

*Director of Patents and Trademarks*